US007555872B1

(12) United States Patent
Beach

(10) Patent No.: US 7,555,872 B1
(45) Date of Patent: Jul. 7, 2009

(54) SPACER FOR ALIGNING CONCRETE BLOCKS

(76) Inventor: Jeffrey Beach, 3374 Arden Rd., China Township, MI (US) 48054

( * ) Notice: Subject to any disclaimer, the term of this patent is extended or adjusted under 35 U.S.C. 154(b) by 867 days.

(21) Appl. No.: 11/029,766

(22) Filed: Jan. 4, 2005

(51) Int. Cl.
*E04B 1/16* (2006.01)
*E04B 2/00* (2006.01)
*E04B 1/02* (2006.01)

(52) U.S. Cl. ..... 52/745.1; 52/379; 52/565; 52/432

(58) Field of Classification Search ..... 52/677, 52/686, 719, 454, 565, 747.12, 419, 431, 52/432, 442, 285.3, 426, 745.1, 745.13, 439, 52/434, 561, 566, 513, 379, 612, 745.09, 52/745.01; 29/897.3, 897.31, 897.312, 897.32, 29/897.34, 453, 525.01; 403/67, 218, 397
See application file for complete search history.

(56) References Cited

U.S. PATENT DOCUMENTS 1,070,921 A * 8/1913 Saltiel ..... 52/686
1,185,969 A * 6/1916 Blackstone ..... 52/293.2
1,760,955 A * 6/1930 Moss ..... 403/174
2,018,539 A * 10/1935 Welsh ..... 403/218
2,141,397 A * 12/1938 Locke ..... 52/204.2
2,635,451 A * 4/1953 Walthers ..... 52/223.7
3,196,581 A * 7/1965 Castelli et al. ..... 52/125.3
3,197,171 A * 7/1965 Michalak ..... 249/40
3,420,031 A * 1/1969 Castelli et al. ..... 52/125.3
3,895,470 A * 7/1975 Wurth ..... 52/686
4,309,120 A * 1/1982 Werthmann ..... 403/18
4,606,163 A * 8/1986 Catani ..... 52/434
4,793,104 A * 12/1988 Hultberg et al. ..... 52/127.3
5,224,314 A * 7/1993 Chen ..... 52/308
5,518,333 A * 5/1996 Cienkus et al. ..... 403/169
5,678,373 A * 10/1997 Franklin et al. ..... 52/439
5,699,997 A * 12/1997 Huang ..... 256/26
5,797,230 A * 8/1998 Lassen ..... 52/323
5,820,305 A * 10/1998 Taylor et al. ..... 405/286
5,893,252 A * 4/1999 Hardy et al. ..... 52/685
5,907,937 A * 6/1999 Loftus et al. ..... 52/308
6,112,494 A * 9/2000 Hardy et al. ..... 52/685
6,212,847 B1 * 4/2001 Park ..... 52/655.1
6,282,860 B1 * 9/2001 Ramirez ..... 52/677
6,321,498 B1 * 11/2001 Trovato ..... 52/426
6,447,203 B1 * 9/2002 Ruiz et al. ..... 404/70
6,629,393 B2 * 10/2003 Pignataro ..... 52/677
6,663,316 B1 * 12/2003 Harris ..... 404/136
6,832,456 B1 * 12/2004 Bilowol ..... 52/426
6,857,240 B1 * 2/2005 MacAlister ..... 52/564
7,108,453 B2 * 9/2006 Harris ..... 404/135
7,461,491 B1 * 12/2008 Sorkin ..... 52/685
2003/0192272 A1 * 10/2003 Bravinski ..... 52/309.11
2004/0064932 A1 * 4/2004 Sprague ..... 29/525.01
2004/0182029 A1 * 9/2004 Berg ..... 52/379
2008/0134605 A1 * 6/2008 Friesen et al. ..... 52/308

* cited by examiner

*Primary Examiner*—Robert J Canfield
*Assistant Examiner*—Brent W Herring
(74) *Attorney, Agent, or Firm*—Michael J. Tavella

(57) ABSTRACT

A spacer that attaches to wire grids used in laying concrete block or similar type block. A number of spacers are used to lay out a pattern in the block. The spacers have fingers that extend upward from the spacers. These fingers are used to align the blocks, above and below, to assure that each course remains level, plumb and square, with the courses of block remaining in proper alignment throughout the construction.

16 Claims, 6 Drawing Sheets

SPACER FOR ALIGNING CONCRETE BLOCKS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to tools for aligning concrete blocks in construction and particularly to spacers that are used to align concrete blocks.

2. Description of the Prior Art

In masonry construction, one of the most used items is the ubiquitous concrete block. These blocks are used to build everything from foundation and walls to backyard bar-b-ques. These blocks are designed to assemble easily and quickly. However, a block construction must be monitored to ensure that the particular construction (e.g., a wall) remains level, plumb and square, with the courses of block remaining in proper alignment throughout the construction. This is a constant problem for experienced professional, it is even more problematic for less skilled workers, especially in a stack bond type of construction.

Thus, it takes a substantial amount of time to ensure that the construction remains level, plumb and square, with the courses of block remaining in proper alignment throughout the construction.

BRIEF DESCRIPTION OF THE INVENTION

The instant invention overcomes this problem. It is a spacer that attaches to wire grids used in laying concrete block or similar type block. A number of spacers are used to lay out a pattern in the block. The spacers have fingers that extend upward from the spacers. These fingers are used to align the blocks, above and below, to assure that each course remains level, plumb and square, with the courses of block remaining in proper alignment throughout the construction.

DETAILED DESCRIPTION OF THE INVENTION

Referring now to FIGS. 1-5, the invention 1 is shown. The invention is a small spacer that is designed to fit over reinforcing wire. The reinforcing wire is then placed over a course of concrete block. The invention spacers align with the ends of the blocks. This ensures that the blocks are properly aligned as the courses are added.

The configuration shown is primarily used in a stack bond type construction. In a stack bond, the block joints line up vertically with each other on every course. In such construction, proper alignment of the blocks is essential to making a strong and aesthetically pleasing wall.

Figure 1:
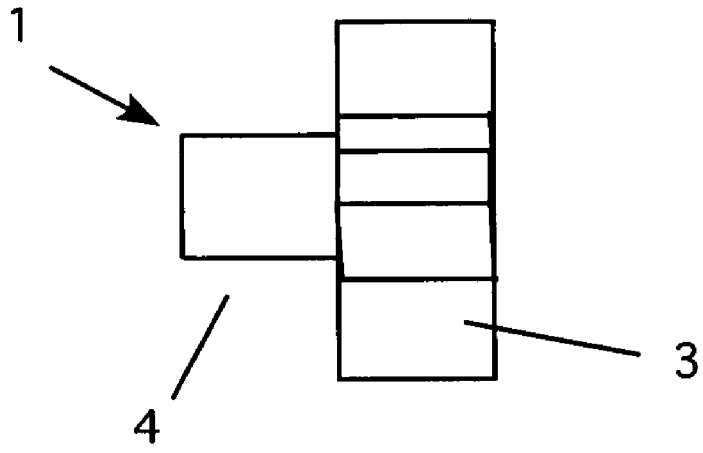
FIG. 1 is a top plan view of the invention.

FIG. 1 is a top plan view of the invention 1. The invention is a formed spacer, preferably made of plastic or similar materials. The spacer forms a "T" shaped member made up of a lateral body 3 and a perpendicular body 4. The perpendicular body 4 has an alignment finger 5 that extends upward above the lateral body (see, e.g., FIG. 3). This finger provides the alignment function, as discussed below.

Figure 2:
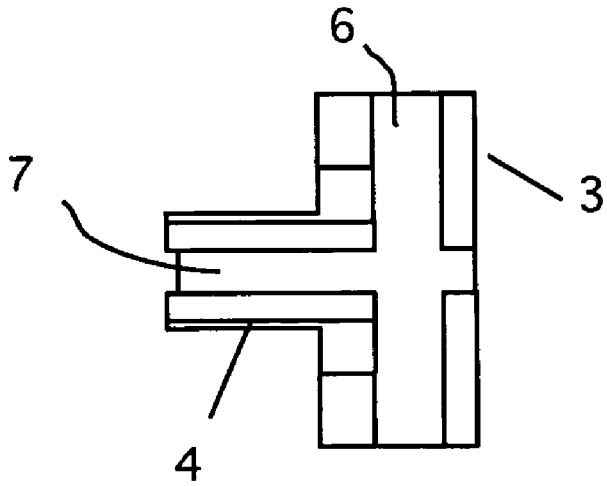
FIG. 2 is a bottom plan view of the invention.

FIG. 2 is a bottom plan view of the invention. Here, the lateral body 3 and perpendicular body 4 form a common base. Two grooves 6 and 7 are formed in the base as shown. These grooves align with spacer onto the reinforcing wire, as discussed below.

Figure 3:
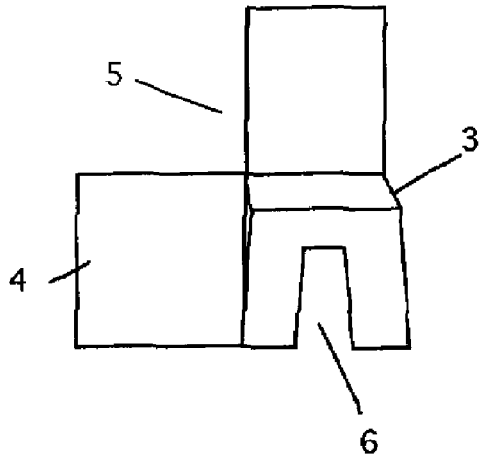
FIG. 3 is a left side elevation view of the invention.

FIG. 3 is a left side elevation view of the invention. Here, the lateral body 3 and groove 6 are shown along with the perpendicular body 4 and the alignment finger 5.

Figure 4:
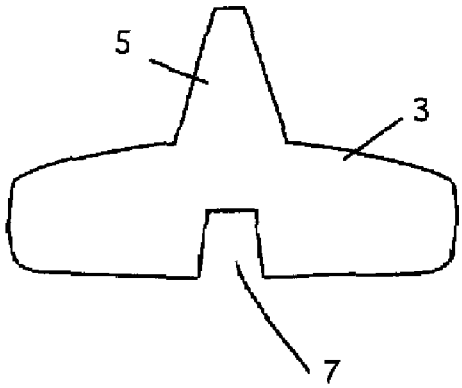
FIG. 4 is a rear elevation view of the invention.

FIG. 4 is a rear elevation view of the invention. In this figure, the alignment finger 5 is shown behind the lateral body 3. Note also that groove 7 is shown in this view. In the preferred embodiment, the top surface of the lateral body 3 is curved. Of course, this body can have a straight or angled top as well.

Figure 5:
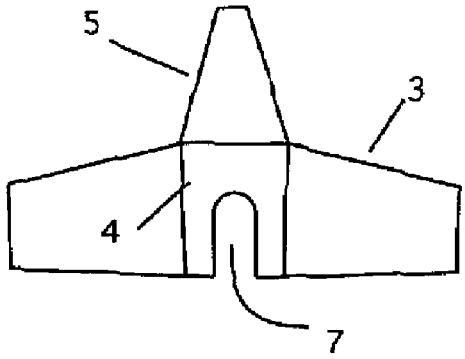
FIG. 5 is a front elevation view of the invention.

FIG. 5 is a front elevation view of the invention. Here, the alignment finger 5 is shown in front of the lateral body 3. The perpendicular body 4 is shown extending forward from the lateral body. Note that in the front portion of the perpendicular body 4, the groove 7 is slightly narrower. This allows the spacer to snap onto the reinforcing wire to ensure a secure grip.

Figure 6:
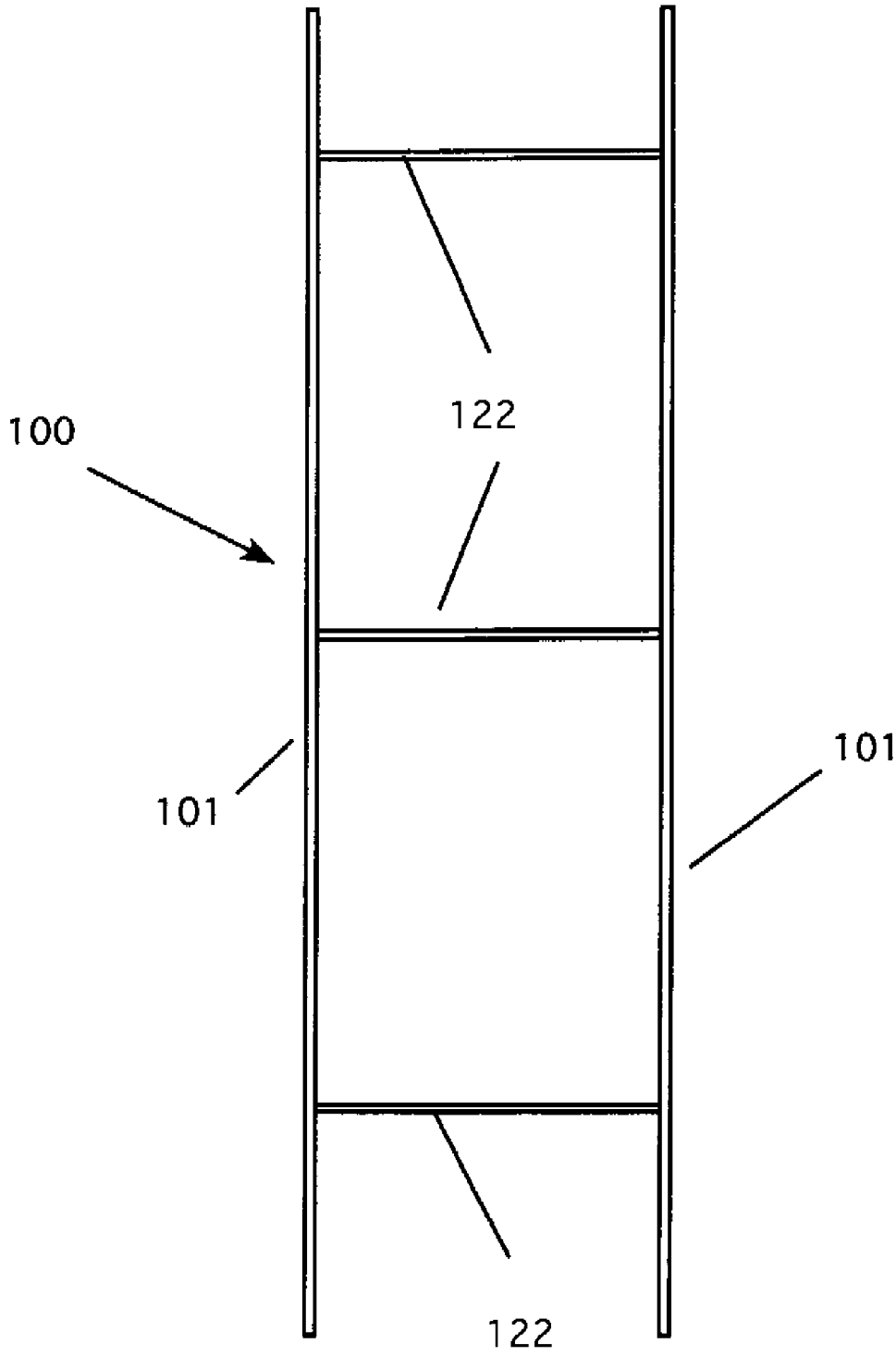
FIG. 6 is a top plan view of a section of reinforcing bar.

FIG. 6 is a top plan view of a section of reinforcing wire. This wire 100 has two parallel members 101 that are connected by perpendicular braces 122. The wire thus forms a rectangular grid that aligns with the form of a typical concrete block, with the parallel members aligning with the sidewalls of the block and the perpendicular braces aligning with the webs of the block. This pattern allows the invention to work.

Figure 7:
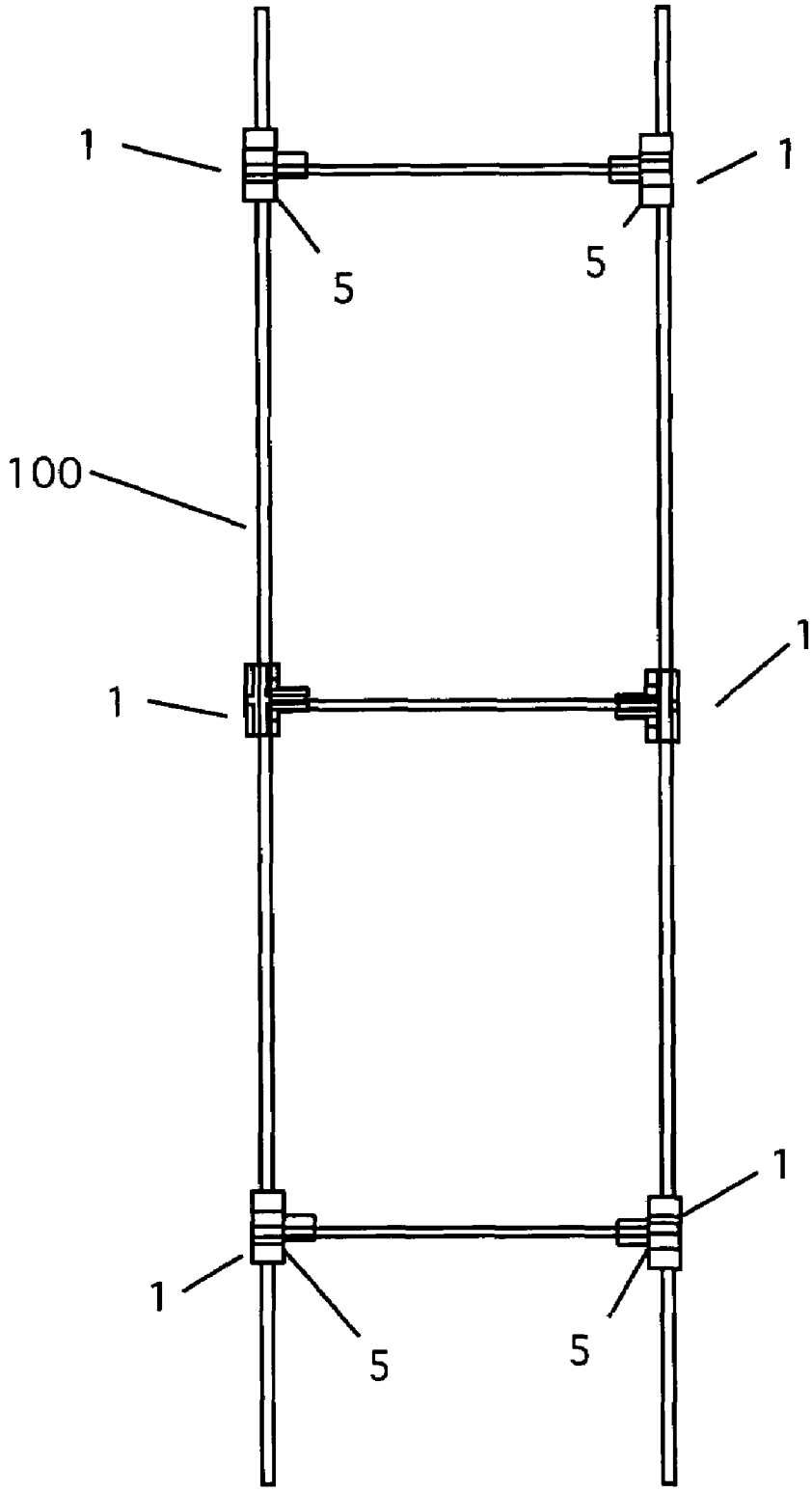
FIG. 7 is a top plan view of a section of reinforcing bar showing the invention spacers in place in the preferred mounting pattern.

FIG. 7 is a top plan view of a section of reinforcing bar showing the invention spacers in place in a mounting pattern for a running bond. Here, six spacers 1 are placed on the reinforcing wire as shown. The two spacers 1 mounted on the top of the figure are positioned with the alignment fingers 5 pointing upward. The two spacers in the center of the figure have the alignment fingers 5 pointing downward. Here, the grooves 6 and 7 can be seen fitting over the parallel members and perpendicular braces. Finally, the two spacers 1 mounted on the bottom of the figure are positioned with the alignment fingers 5 pointing upward. This produces an alternating pattern that is used to align the block.

Once a line of block has been placed, the reinforcing wire, with the spacers attached can be placed over the blocks. The alignment fingers 5 fit between the ends of the block and are placed tight against edge. There are three main configurations of block construction: a stack bond, a stack bond with half-blocks and a running bond.

Figure 8:
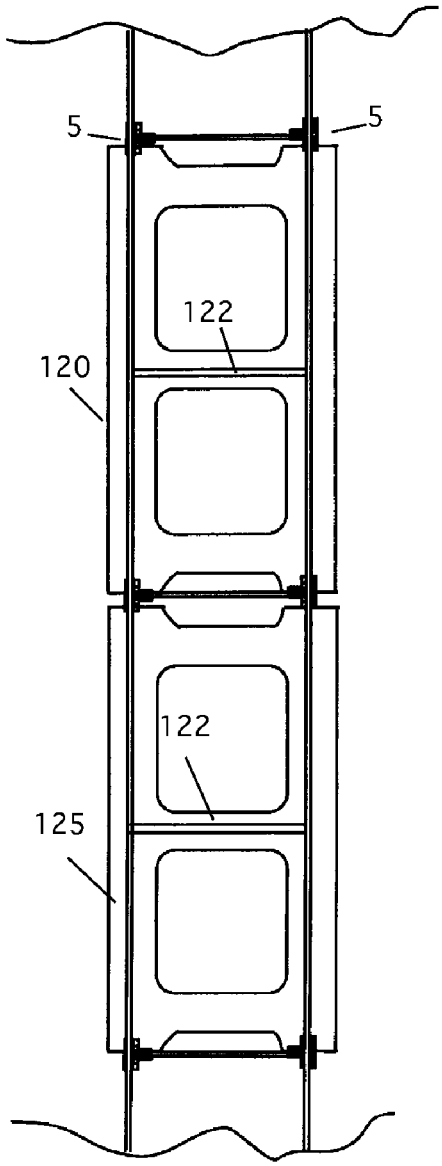
FIG. 8 is a top plan view of a section of reinforcing bar showing the invention spacers in place on a row of blocks, being configured for a stack bond.

FIG. 8 is a top plan view of a section of reinforcing bar showing the invention spacers in place on a row of blocks, being configured for a stack bond. With normal spacing, the two alignment fingers 5 at the top of FIG. 8 fit on the end of one block 120. In a stack bond of full blocks, there are no alignment fingers placed on the center wires 122 as shown. The alignment fingers at the center of FIG. 8 fit between block 120 and adjoining block 125. The spacers at the bottom of the wire align with the bottom block 125. As the next course of block is placed, the edges of the block align with the edges of the blocks in the first course. That makes a stack bond. Note that the wires shown in FIGS. 7-11 show only a small portion of reinforcing wire. In reality, this pattern runs for several feet.

Figure 9:
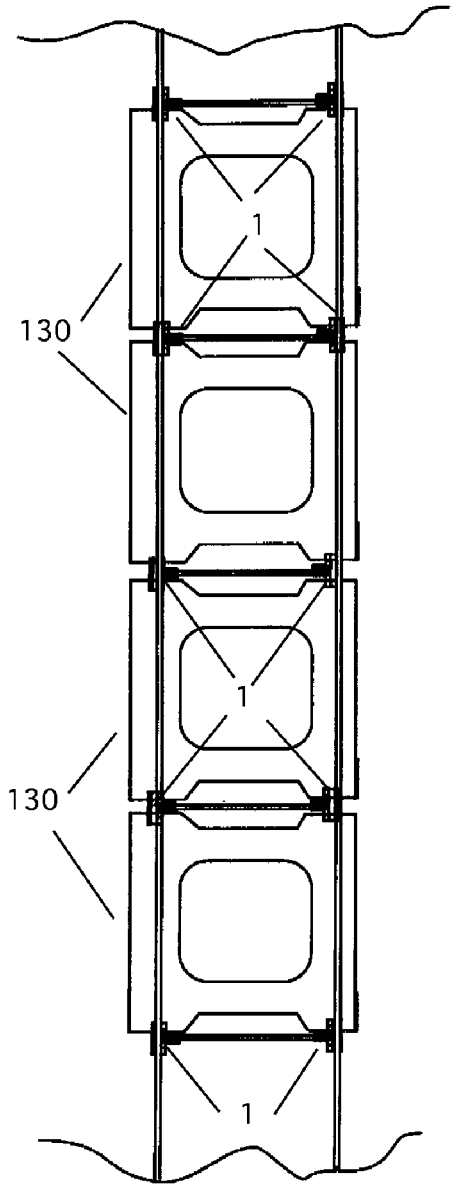
FIG. 9 is a top plan view of a section of reinforcing bar showing the invention spacers in place on a row of half-blocks, being configured for a stack bond.

FIG. 9 is a top plan view of a section of reinforcing bar showing the invention spacers in place on a row of half-blocks, being configured for a stack bond. Here, half-blocks 130 are used. As before the spacers 1 are placed at the ends of each block. Here, however, the spacers 1 must also be placed on the center wires 122. This allows the half-blocks to be properly aligned as in the case of full blocks.

Figure 10:
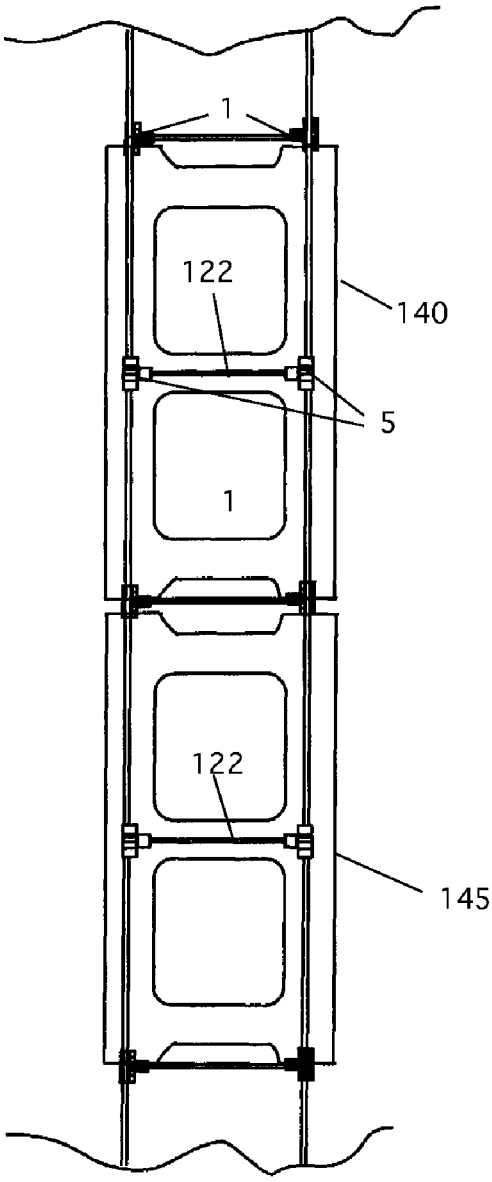
FIG. 10 is a top plan view of a section of reinforcing bar showing the invention spacers in place on a row of blocks, being configured for a running bond.

The third configuration is the running bond. FIG. 10 shows a row of blocks with the spacers in place on a reinforcing wire. With normal spacing, the two spacers 1 are aligned with the end of one block 140. Note that for a running bond, spacers are also placed on the center wires 122. Here, alignment fingers 5 are inverted. This allows the alignment fingers to align then ext course (as discussed below). The next pair of spacers 1 aligns with the rear end of block 140 and the front end of block 145. This pattern then repeats for the length of the wall.

Figure 11:
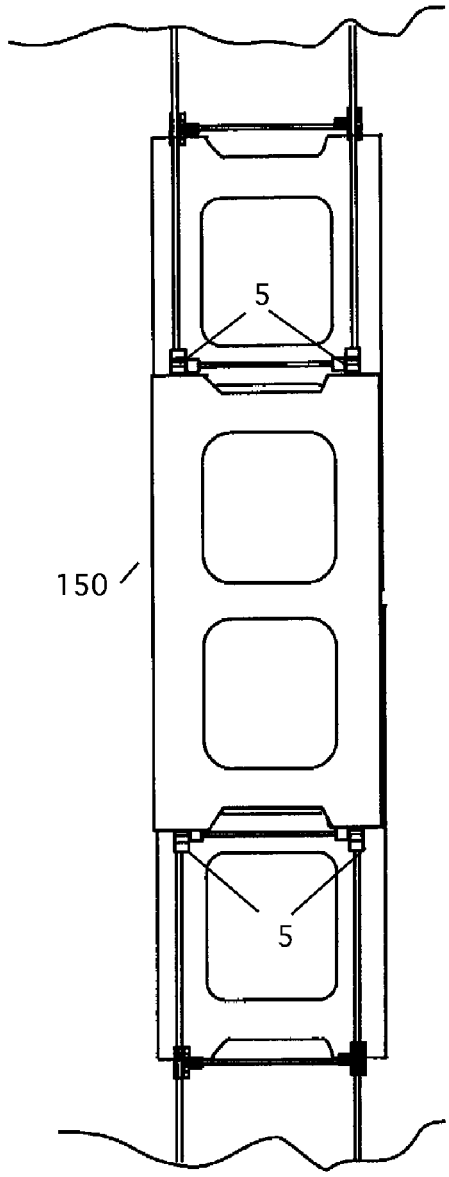
FIG. 11 is a top plan view of a section of reinforcing bar showing the invention spacers in place on a row of blocks, being configured for a running bond with a single second-course block in place, forming a running bond.

In a running bond, as the next course of block is placed, the edges of the upper block are typically offset from the ends of the lower course. To ensure proper alignment, the end of the block in the next course aligns with the alignment fingers of the center pair of spacers. FIG. 11 is a top plan view of a section of reinforcing bar showing the invention spacers in place on a row of blocks, being configured for a running bond with a single second-course block 150 in place, forming a running bond. As the figure shows, the alignment fingers 5 from below align with the ends of block 150. This operation is repeated with each new course with the alignment spacers in place, thereby ensuring that each course is properly aligned as the construction continues.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A method of use for a device for aligning masonry block for use with reinforcing wire having a pair of parallel members connected by a plurality of perpendicular braces, such that each of said plurality of perpendicular braces attaches to each of said pair of parallel members, forming a plurality of joints, and wherein the device has a spacer body having a lateral member and a perpendicular member, said lateral member and a perpendicular member forming a "T" shaped member, wherein said lateral member and a perpendicular member having a base and further wherein said base has two perpendicular grooves formed therein; and an alignment finger, formed on said perpendicular member and extending upward therefrom, comprising the steps of:

a) placing a line of masonry block in a desired location, b) preparing a length of the reinforcing wire by the steps of:

i) positioning one each of said device on each of said plurality of joints such that one device is aligned with a section of the reinforcing wire such that the perpendicular grooves align with one of the parallel members and one of the plurality of perpendicular braces; and ii) pressing said device onto said reinforcing wire until the one of the parallel members and one of the plurality of perpendicular braces snap into the perpendicular grooves on the device; and c) positioning the prepared length of reinforcing wire on top of said line of masonry block.

2. The method of claim 1 wherein a plurality of devices is attached to the reinforcing wire in a rectangular pattern.

3. The method of claim 1 wherein the plurality of devices and reinforcing wire are used in the construction of a block wall.

4. The method of claim 3 wherein the each of the masonry blocks has a pair of ends, the method further comprising the step of aligning each of said devices with one of said pair of ends in said line of masonry blocks.

5. The method of claim 3 wherein the each of the masonry blocks has a pair of ends, the method further comprising the step of aligning each of said devices with one of said pair of ends in said line of masonry blocks.

6. The method of claim 5 wherein the block wall has a stack bond configuration.

7. The method of claim 5 wherein the block wall has a running bond configuration.

8. The method of claim 1 wherein the step of positioning a device on each of said plurality of joints further includes the steps of:

a) positioning a first pair of devices oppositely disposed on a first pair of joints;

b) positioning a second pair of devices oppositely disposed on a second pair of joints; and c) repeating steps a and b for the length of the reinforcing wire.

9. A method of use for a device for aligning masonry block for use with reinforcing wire having a pair of parallel members connected by a plurality of perpendicular braces, such that each of said plurality of perpendicular braces attaches to each of said pair of parallel members, forming a plurality of joint pairs extending in a longitudinal direction down the length of the pair of parallel members, and wherein the device has a spacer body having a lateral member and a perpendicular member, said lateral member and a perpendicular member forming a "T" shaped member, wherein said lateral member and a perpendicular member having a base and further wherein said base has two perpendicular grooves formed therein; and an alignment finger, formed on said perpendicular member and extending upward therefrom, comprising the steps of:

a) positioning a first pair of devices oppositely disposed on a first pair of joints such that the alignment fingers on the first pair of devices extend upwardly with respect to said length of reinforcing wire;

b) skipping over the next pair of joints; and c) positioning a second pair of devices oppositely disposed on a third pair of joints such that the alignment fingers on the second pair of devices extend downwardly with respect to said length of reinforcing wire.

10. The method of claim 9, further comprising the steps of:

a) after step c, skipping over a fourth pair of joints;

b) positioning a third pair of devices oppositely disposed on a fifth pair of joints such that the alignment fingers on the third pair of devices extend upwardly with respect to said length of reinforcing wire;

c) skipping over a sixth pair of joints;

d) positioning a fourth pair of devices oppositely disposed on a seventh pair of joints such that the alignment fingers on the fourth pair of devices extend downwardly with respect to said length of reinforcing wire; and e) repeating steps a and d for the remainder of the joints on said length of reinforcing wire.

11. A method of use for a device for aligning masonry block for use with reinforcing wire having a pair of parallel members connected by a plurality of perpendicular braces, such that each of said plurality of perpendicular braces attaches to each of said pair of parallel members, forming a plurality of joint pairs extending in a longitudinal direction down the length of the pair of parallel members, and wherein the device has a spacer body having a lateral member and a perpendicular member, said lateral member and a perpendicular member forming a "T" shaped member, wherein said lateral member and a perpendicular member having a base and further wherein said base has two perpendicular grooves formed therein; and an alignment finger, formed on said perpendicular member and extending upward therefrom, comprising the steps of:

a) positioning a first pair of devices oppositely disposed on a first pair of joints such that the alignment fingers on the first pair of devices extend upwardly with respect to said length of reinforcing wire;

b) skipping over the next pair of joints; and c) positioning a second pair of devices oppositely disposed on a third pair of joints such that the alignment fingers on the second pair of devices extend downwardly with respect to said length of reinforcing wire.

12. The method of claim 11, further comprising the steps of:

a) after step c, skipping over a fourth pair of joints;

b) positioning a third pair of devices oppositely disposed on a fifth pair of joints such that the alignment fingers on the third pair of devices extend upwardly with respect to said length of reinforcing wire;

c) skipping over a sixth pair of joints;

d) positioning a fourth pair of devices oppositely disposed on a seventh pair of joints such that the alignment fingers on the fourth pair of devices extend downwardly with respect to said length of reinforcing wire; and e) repeating steps a and d for the remainder of the joints on said length of reinforcing wire.

13. The method of claim 11 wherein a plurality of devices is attached to the reinforcing wire in a rectangular pattern.

14. The method of claim 11 wherein the each of the masonry blocks has a pair of ends, the method further comprising the step of aligning each of said devices with one of said pair of ends in said line of masonry blocks.

15. The method of claim 11 wherein the block wall has a stack bond configuration.

16. The method of claim 11 wherein the block wall has a running bond configuration.

* * * * *